US011905071B2

(12) United States Patent
Sang

(10) Patent No.: US 11,905,071 B2
(45) Date of Patent: Feb. 20, 2024

(54) AUTO-LOCK SEALING VALVE STRUCTURE OF A RUBBER JOINTING RING IN THE CONTAINERS USING A LID ATTACHED TO THE RUBBER JOINTING RING

(71) Applicant: Ly Huy Sang, Thuan An (VN)

(72) Inventor: Ly Huy Sang, Thuan An (VN)

( * ) Notice: Subject to any disclaimer, the term of this patent is extended or adjusted under 35 U.S.C. 154(b) by 0 days.

(21) Appl. No.: 17/963,990

(22) Filed: Oct. 11, 2022

(65) Prior Publication Data

US 2023/0117063 A1 Apr. 20, 2023

(30) Foreign Application Priority Data

Oct. 18, 2021 (VN) ..... 1-2021-06569

(51) Int. Cl.
*B65D 39/00* (2006.01)
*B65D 39/16* (2006.01)

(52) U.S. Cl.
CPC ..... *B65D 39/0017* (2013.01); *B65D 39/16* (2013.01)

(58) Field of Classification Search
CPC ..... B65D 39/0017; B65D 39/16; B65D 39/0058; B65D 39/0064; B65D 39/04
USPC ..... 215/296
See application file for complete search history.

(56) References Cited

U.S. PATENT DOCUMENTS 3,900,124 A * 8/1975 Marcel ..... B65D 55/063 604/360
6,536,618 B1 * 3/2003 Hwang ..... B65D 39/12 215/361
11,628,992 B2 * 4/2023 Exley ..... B01J 20/103 215/230
2008/0223812 A1 * 9/2008 Domagala ..... B65D 39/0076 215/230

FOREIGN PATENT DOCUMENTS

DE 102016102574 B3 * 4/2017
EP 2692659 A1 * 2/2014 ..... B65D 39/0047
EP 3971101 A1 * 3/2022 ..... B65B 7/2828
RU 182509 U1 * 8/2018

* cited by examiner

*Primary Examiner* — J. Gregory Pickett
*Assistant Examiner* — Niki M Eloshway
(74) *Attorney, Agent, or Firm* — Muncy, Geissler, Olds & Lowe, P.C.

(57) ABSTRACT

An auto-lock sealing valve structure of a rubber jointing ring using the lid attached to the rubber jointing ring includes a lid, a rubber jointing ring, and a bottle body. The rubber jointing ring connects the lid and the bottle body. The designation of the vapor escaping groove in the lid body helps the air inside the rubber jointing ring escape out, simultaneously the raised edge on the bottle lid prevents the rubber jointing ring part from coming out off. The gaps on the body part of the rubber jointing rings help the air inside the bottle body to entirely escape but still ensure that the liquid inside the devices cannot escape.

7 Claims, 6 Drawing Sheets

I

II

III

IV

AUTO-LOCK SEALING VALVE STRUCTURE OF A RUBBER JOINTING RING IN THE CONTAINERS USING A LID ATTACHED TO THE RUBBER JOINTING RING

FIELD OF THE INVENTION

The present invention refers to rubber jointing rings having an auto-lock valve in the container products using a lid attached rubber jointing rings (hereinafter described in a particular product is a ceramic bottle having a lid attached rubber jointing rings).

BACKGROUND OF THE INVENTION

For a long time, a rubber jointing ring was an important material in various industries, it was considered as a protective tool to protect other articles to avoid impacts or undesirable events in the mechanical industry. The rubber jointing ring was used mostly in the electricity and water industry, the oil and gas industry, and the construction industry. Specifically, the rubber jointing ring was also used a lot in the medical and food industries. Effects of the rubber jointing ring are: firstly for use in water-proof, dust-proof, sound isolation, and warm-keeping, secondly for use in filling between gaps, for increasing tightness and seals of the products. These are especially interested in the following products: food boxes, thermal cups, drink containers made of metals or ceramics, etc. However, the second effect of using rubber jointing rings for the above products has many drawbacks:

Firstly, the lid part and the body part of the product are not entirely closed because the inside air did not escape ultimately, resulting in a condition that the lid part is lifted while closed for a while.

Secondly, the jointing ring part separated from the lid part results in a water-leaking state.

Thirdly, the rubber jointing ring part separated from the lid part results in that the inside liquid leaks along to the gap between the jointing ring and the lid, then it sticks inside the gap so that it is difficult to be cleaned up by the user.

Fourthly, most products use rubber jointing rings to increase their tightness and seals when containing the liquid at elevated temperature (boiled water, hot tea, hot coffee, or other hot drinks). After cooling, the lid part will stick tightly to the body part so that it is difficult to open the lid. The inside air will expand when pouring the liquid into the body part. After closing the lid and cooling down the liquid, the inside air will shrink to vacuum the inside air. As a result, the lid part sticks tightly to the body part, so it will be difficult to release.

SUMMARY OF THE INVENTION

The object of the present invention is to overcome the drawbacks of the rubber jointing rings which are commercially available. To achieve the object mentioned above, the present invention provides a device containing the liquid made of ceramics using rubber jointing rings an auto-lock valve including:

1. The lid part

The lid is designed with the body part of the lid having 02 concave grooves that are opposite each other to help fit the rubber jointing ring and the lid more easily because the inside air of the jointing ring will escape through 02 concave points mentioned above.

The sole part of the lid has a raised edge to help keep the jointing ring part firmly attached to the lid (avoiding the state that the jointing ring is released from the lid when opening and closing the lid).

2. The rubber jointing ring

The rubber jointing ring has 4 sealing layers:

The first layer is on the bottom, in the shape of flat cylinder, to let only the air inside the bottle body escape but still ensure that the liquid does not escape.

The 2nd and 3rd layers, which are designed in the cauldron shape with gaps that are eccentric each other, are above the first layer so that the air inside the container escapes ultimately so that the lid part and the body part will be entirely closed. Furthermore, these 2 layers are thicker and stiffer than the first layer to keep the lid more firmly to the body part of the container.

The top layer is immediately on the downside of the lid, and it fills the gap between the lid and the opening of the liquid container to increase its tightness and seals.

Layers of the rubber jointing ring are designed in the cauldron shape according to different distances, thicknesses, thinnesses to prevent the air inside the container from escaping ultimately.

The rubber jointing ring is an integrated block to avoid the liquid leaking, simultaneously removing the liquid sticking on the gaps between the rubber jointing ring and the bottle body causing unhygienic conditions in the use duration.

3. A container

A container in the type of a bottle has the top part in the type of a hopper with an opening part and the bottleneck in the type of a cylinder and is successively bigger down to the bottle body. The inside of the bottle's neck is immediately beside the opening designed in the V shape and having 2 concave edges. The concave edges near the bottle opening are broader than the lower concave edges.

The upper concave edges have dimensions suitable for inserting the lid part with a rubber jointing ring into the inside without any difficulty. The inside air escapes mainly from those concave edges.

4. The whole liquid container is made of ceramics to ensure the hygiene and the safety of the container, do not create toxic substances because of the direct contact with the liquid at the elevated temperature during the storage progress, the use of the liquid, keeping the inside liquid to be pure without loss or having other odor impurities like other containers made of metals, plastic, etc.

BRIEF DESCRIPTION OF THE DRAWINGS

The present invention will be explained in more detail below by exemplary embodiments in reference to the appended drawings, wherein.

DETAILED DESCRIPTION OF THE INVENTION

Figure 1:
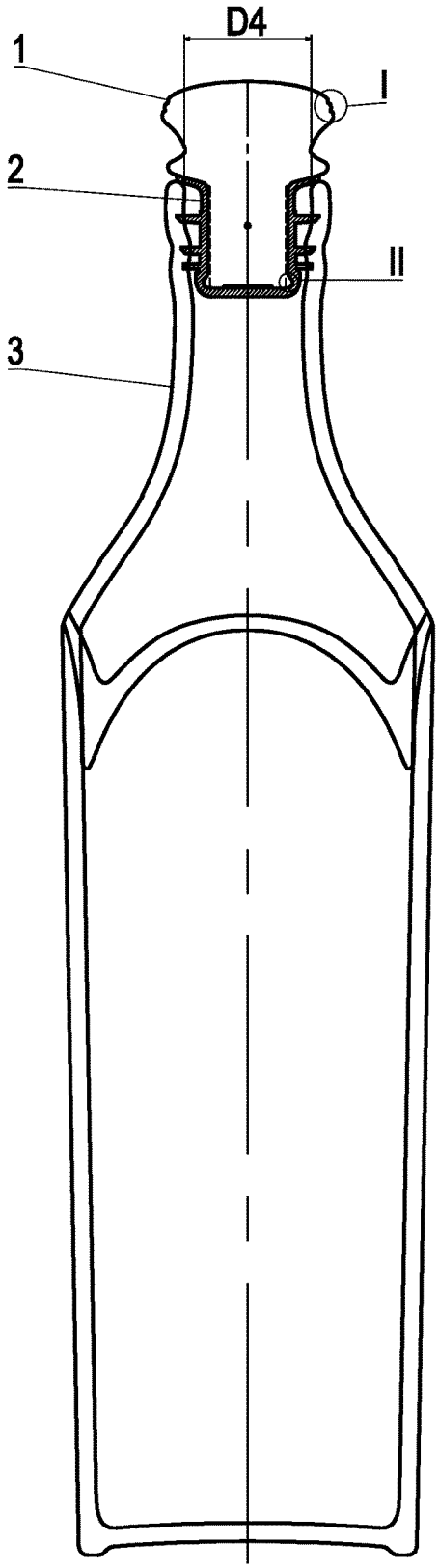
FIG. 1 is a general arrangement drawing representing a liquid container.

The present invention is described in detail according to the preferred embodiments based on the appended drawings, wherein:

FIG. 1 represents a liquid container with a closed lid including a lid 1, a rubber jointing ring 2 provided enclosing outside of the body part of the lid 1, a water bottle (a container) 3 is connected to the lid 1 by the rubber jointing ring 2. The rubber jointing ring 2 functions to prevent the liquid from overrun in the use duration, and simultaneously pushes the air inside the water bottle to escape during opening/closing the bottle lid.

Figure 2A:
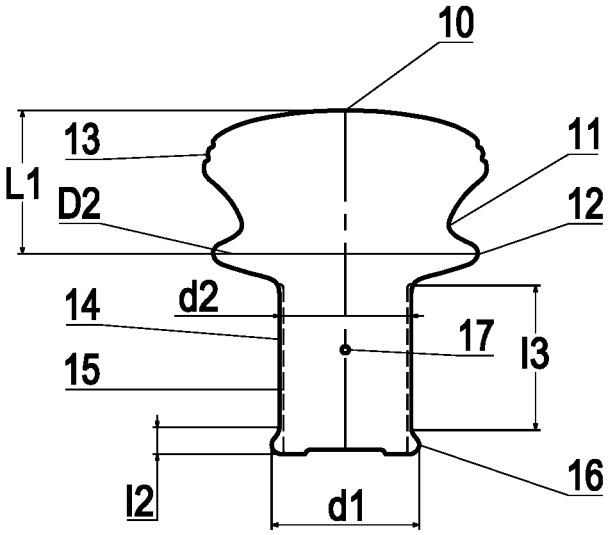
FIG. 2*a*, FIG. 2*b*, FIG. 2*c*, FIG. 2*d* are the front cross-sectional view, the plan view and the bottom view, and the side view representing a cap.
Figure 2D:
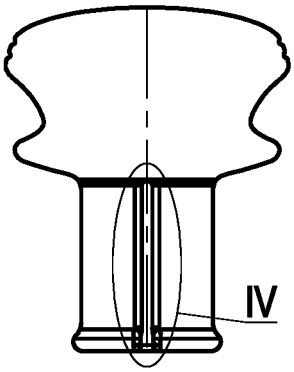
Figure 2B:
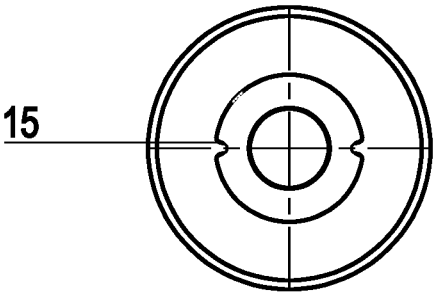
Figure 2C:
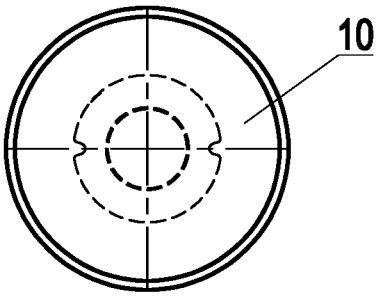
Figure 3A:
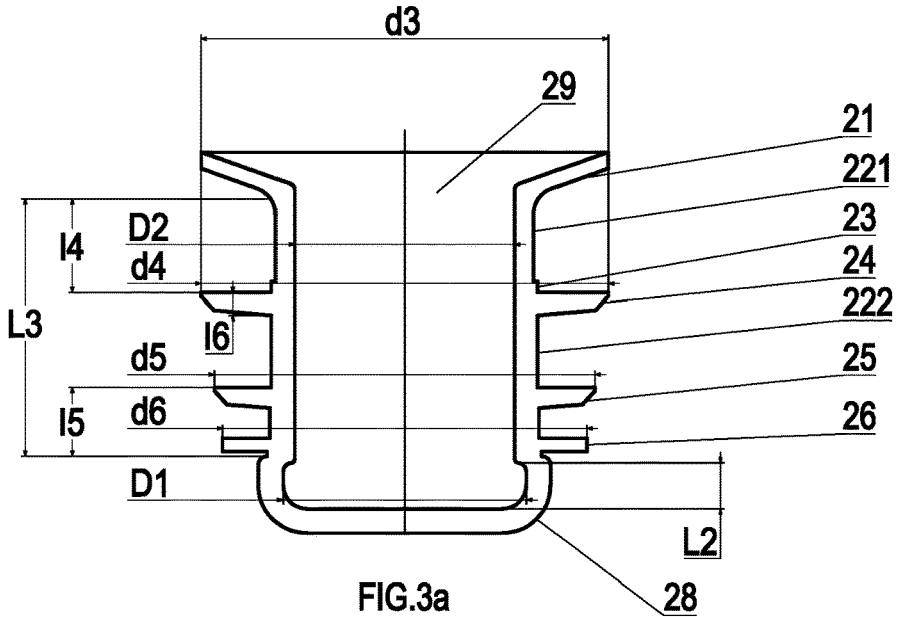
FIG. 3*a*, FIG. 3*b*, FIG. 3*c* are the side cross-sectional view and the plan view and the bottom view representing a rubber jointing ring.
Figure 3B:
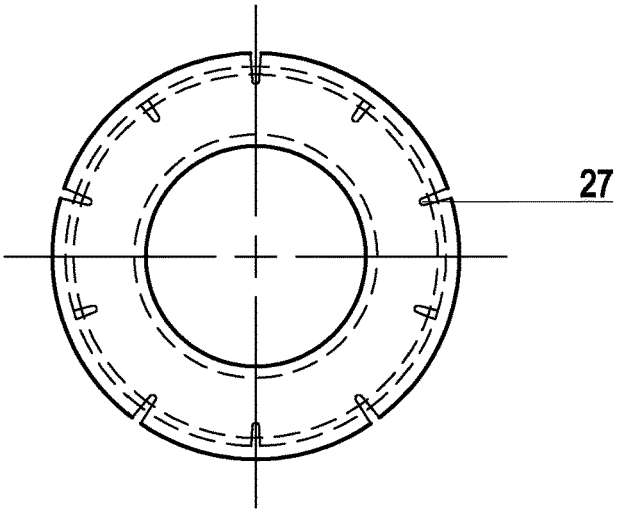
Figure 3C:
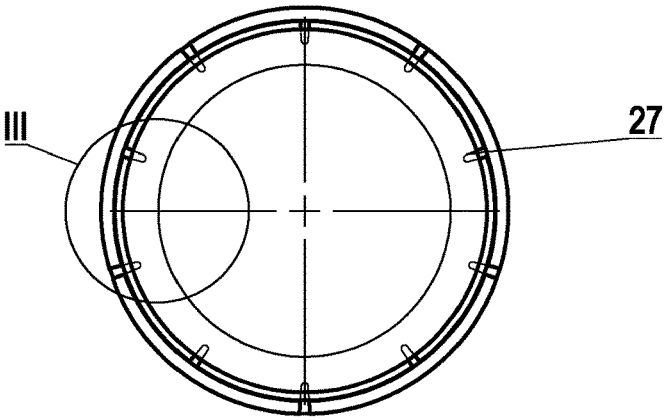
Figure 4A:
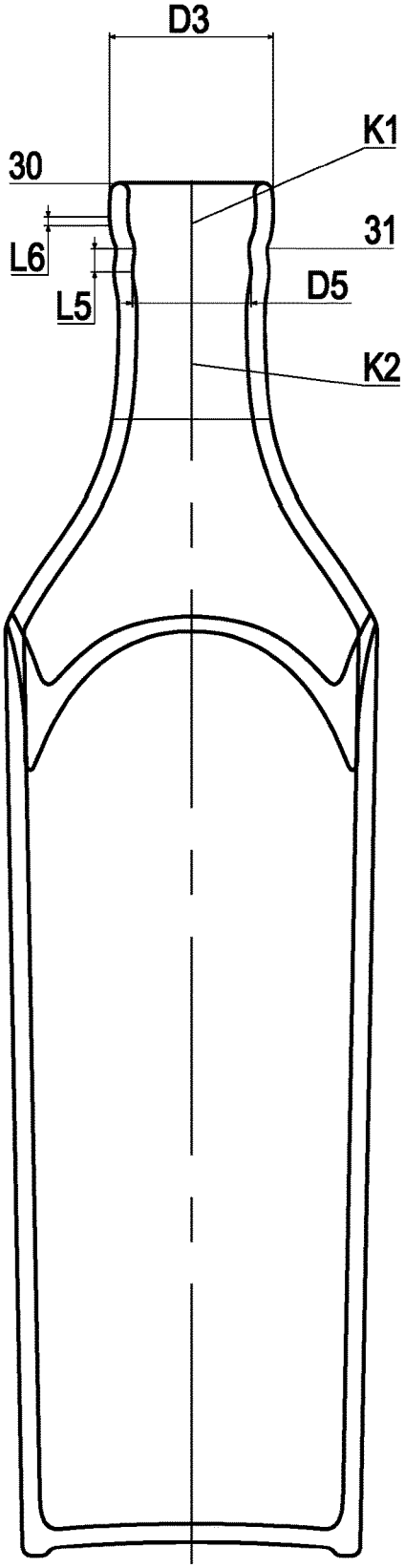
FIG. 4*a*, FIG. 4*b*, are the front view representing the body part of the liquid container and partly enlarged view of the opening of the devices.
Figure 4B:
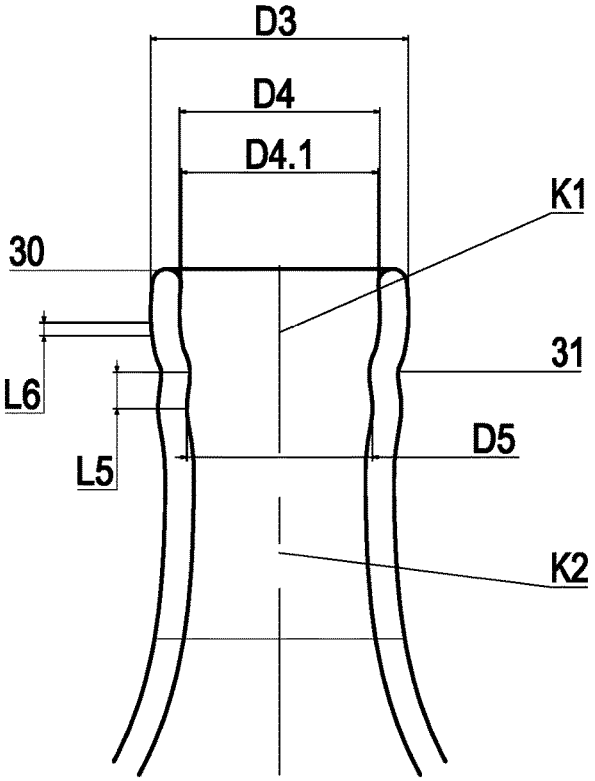
Figure 5:
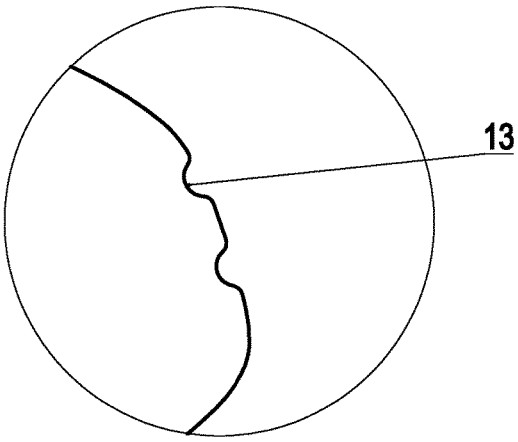
FIG. 5 is a partly enlarged view I, representing the concave groove 13 on the lid 1.
Figure 6:
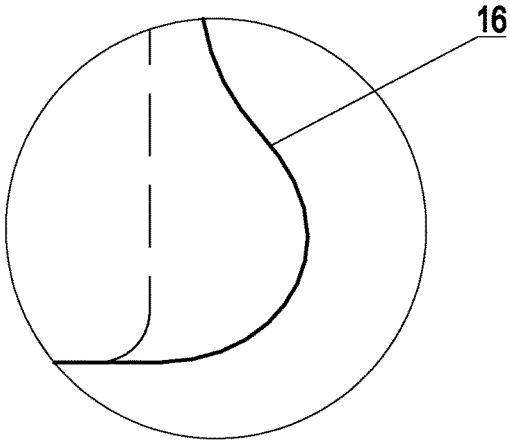
FIG. 6 is a partly enlarged view II, representing a raised edge 16 on the lid 1.
Figure 7:
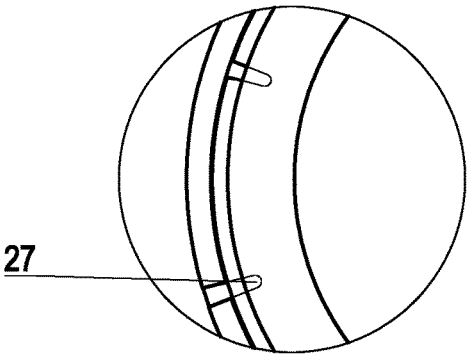
FIG. 7 is a partly enlarged view III, representing the gap 27 on the rubber jointing ring 2.
Figure 8:
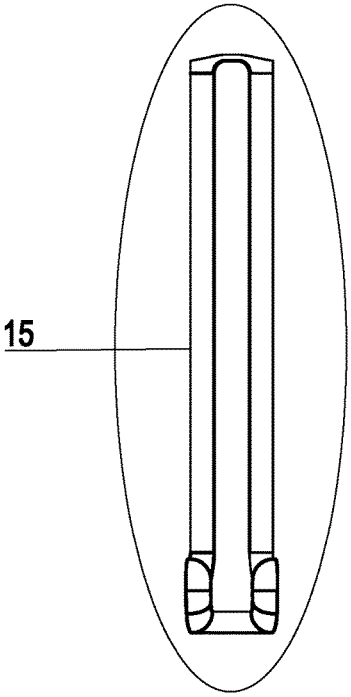
FIG. 8 is a partly enlarged view IV, representing a vapor escaping groove 15 on the lid 1.
Figure 9A:
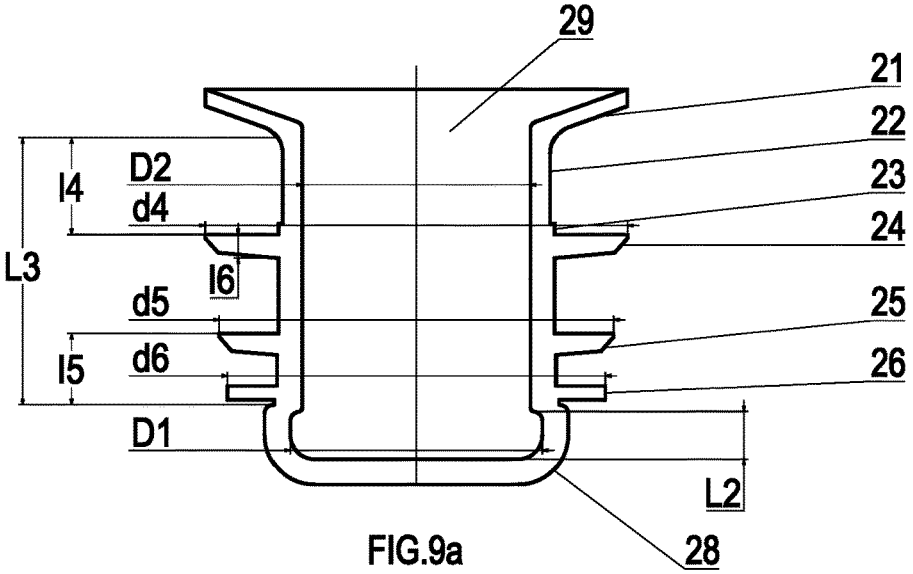
FIG. 9*a*, FIG. 9*b*, FIG. 9*c* are drawings representing the dimensional ratio of the sealing parts of the rubber jointing ring in a free condition and a sealing condition (upon closing the lid).
Figure 9B:
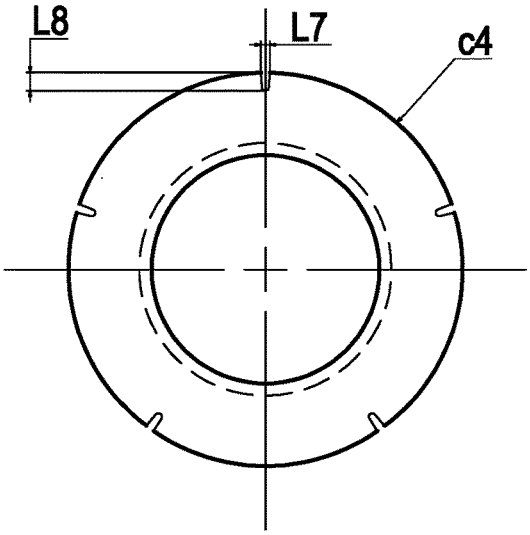
Figure 9C:
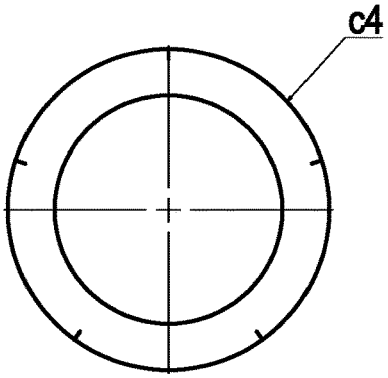

FIGS. 2*a-d* represents a lid, wherein FIG. 2*a* is the front view, FIG. 2*b* is the bottom view, FIG. 2*c* is the plan view FIG. 2*d* is the side view. As represented on the figures, the lid 1 has an outside rim 10 with a torus-shaped part, having a sphere cap-shaped peak summit curving up the and a leg 11 connected to the edge 12. On the outside rim 10 there are eccentric concave grooves 13 (represented more clearly on FIG. 5), the grooves 13 are slip resistant so that the manual handle of the lid 1 will be easier, the grooves preferably have a depth in a range from about 0.5 mm-1 mm. The concave part 11 has a wall on the hopper with a diameter of the hopper leg that is less about 3-4 mm than the diameter of the outside rim 10. The concave part aids in manually handling the lid more easily upon opening and closing it, most preferably, the leg height L1 ranges from about 7-10 mm. If L1 is too long, it will be bulky. If it is too small, it will be unuseful. The edge 12 is in the torus shape with a cross-section radius of about 2-3 mm and the outer diameter D2 to be equal to the outer diameter D3 of the bottle opening, and this will ensure that the connection of the lid 1 and the bottle body 3 will be tight and sealed by the rubber jointing ring 2. The lid body 14 is in the circular cylinder shape extending downwardly. Two side surfaces of the lid body 14 have 02 vapor escaping grooves 15 provided central symmetry (represented more clearly on FIG. 8). The grooves 15 are suitably placed and have suitable dimensions so that upon inserting the rubber jointing ring 2 into the lid 1, a part of the grooves will be placed inside the rubber jointing ring. This placement will balance the vapor pressure inside the rubber jointing ring, avoiding the closed pressure phenomenon that will cause "vapor puffing," making it difficult to insert the rubber jointing ring and the lid. However, if the dimensions of the grooves 15 are too big, the vapor can escape. As a result, the rubber jointing ring will be easily released from the lid. Most preferably, the grooves 15 have dimensions of Length×Width×Depth=9 mm×2 mm×0.8 mm. The raised edge 16 is in the torus shape, having the outer diameter d1 that is longer of about 1-2 mm than the outer diameter d2 of the lid body 14. Therefore, the raised edge 28 of the rubber jointing ring is kept tightly to the lid body and does not come out off during opening, closing the bottle lid. Two small radial holes 17 are almost in the middle of the body 14, having a depth of about 1% cross-sectional radius of the body 14 for vapor escaping, expanding compensation upon heating the lid 1.

The inside of the rubber jointing ring 2 is the body part 22 in a hollow cylinder shape, and the outside has four sealing layers packing on each other in a specific interval. The jointing ring layer 21 on top is in the hopper shape with the expanding part upwardly. The outer rim diameter of the layer 21 equals the outer diameter D2 of the lid 1 and the outer diameter D3 of the bottle opening. This will ensure that the connection of the lid 1 and the bottle body 3 will be tight and sealed (avoiding impacts between a raised edge 16 of the lid 1 and the opening 30 of the bottle body 3). The body part 22 is in a cylinder shape, and the convex edge 23 has a diameter D5 that is longer of about 1-2 mm than the diameter of the body part 22. The edge 23 makes a border separating the cylinder body part 22 of the jointing ring 2 into two parts. An upper part 221 is thinner than the lower part 222. Therefore, the upper part 221 insertion into the lid 1 upon assembling becomes easier. The distance L3 is the height of the body part 22 from the bottom side of the layer 21 to a raised edge of the body part 22. The distance helps to pass fingers through so that assembling the rubber jointing ring 2 and the lid 1 becomes more effortless. Most preferably, L3>5 mm. The jointing ring layers 24 and 25 have the same structures and functions, with a flat upper surface and the cauldron-shaped bottom surface upwardly. On the body part of the jointing ring layers 24 and 25, there are 05 small gaps 27 provided regularly spaced and central symmetric, the interval between gaps is 15-17 mm. The gaps 27 above will help the air inside the bottle escape entirely upon assembling so that not cause the vapor barrier phenomenon when closing the lid. However, if the dimensions of these gaps are too big, the vapor will escape, causing the inside heat to be lost (in case the contained liquid at an elevated temperature), simultaneously these gaps will not close ultimately, resulting in the liquid leaking and the bottle lid will come out easier off the water bottle. Most preferably: these gaps 27 have an opening width of about 0.5-1 mm. Two side walls of the radial gap make a gap successively narrower toward the central point of the cylinder. The gaps 27 are provided uneccentrically and alternatingly in the jointing ring layers 24 and 25, 26. This helps the inside air to not escape together in the same direction. This also helps keep the liquid in the layer 24 if it leaks through the layer 25 and the layer 26. The layer 26 is in a circular cylinder shape with the flat upper and bottom surfaces. This layer lets only the inside air pass through and prevents the liquid from overrunning to the outside. The outer rim diameter of the layers 24, 25, 26 (d4, d5, d3) successively reduces from up to bottom, corresponding to the bottle's neck diameter that equals the closing level of the lid. The raised edge 28 of the jointing ring has the flat top and bottom surfaces, and the body part in the middle of the edge that was rounded with its diameter longer than the outer diameter of the raised edge 23 of the lid. Therefore, the raised edge 28 entirely enclosures the raised edge 23. The hollow inside 29 and the raised edge 28 have shapes and dimensions D1, L2 provided adaptable to dimensions d1, 12 of the lid 1. Thus, the body part 14 and the raised edge 16 of the lid 1 fit in the inside of the rubber jointing ring 2. Most preferably, d1, d2 are longer of about 0.5-1 mm than D1, D2 (because the rubber jointing ring is elastic, so that d1, d2, which are longer than D1, D2, help keep the rubber jointing ring more firmly to the cap). The rubber jointing ring is made based on the following ratio:

The outer boundary perimeter of the rim 24 when has not been inserted: c4=d4×3.14

The outer boundary perimeter of the rim 24 when has been inserted (the perimeter of the container opening at the position of the inserted sealing rim 24): C4=D4×3.14

The width of the groove opening/gap $$L7=(c4-C4)/n$$

n: number of grooves depth of grooves $$L8=[(d4-D4)/2]\times 1.5$$

Container 3 is in the shape of an upside-down hopper with an opening part and a bottle's neck which is substantially cylinder and is successively bigger down to the bottle body. The inside of the bottle opening 30 and the concave edge 31 (protruded toward the inside) are in shape and dimensions D3, L3, D4, L4 provided adaptable to dimensions d3, 13, d4, 14 on the rubber jointing ring 2. Therefore, the bottom part 28 and the layers 24, 25, and 26 of the rubber jointing ring fit inside the bottle opening 30 and the concave edge 31. Most preferably, d3, d4 are longer of about 0.5-1 mm than D3, D4. The concave edge 31 helps keep the bottom part 28 of the rubber jointing ring 2. Most preferably, the concave edge 31 has dimensions of Width×Depth=2 mm×0.8 mm.

More particularly, the bottle opening and the bottle's neck are structured with two interconnected hollow parts K1 and K2. The hollow part K1 on top directly contacts the container opening in the cylinder shape with a diameter D4 at the largest-cross-section position corresponding to the position of the layer 24 upon assembling; the upper opening D4.1 has a diameter that is slightly smaller than D4. The hollow part K2 is in the hollow torus shape having a diameter D3 at the largest-cross-section position corresponding to the position of the layer 26 upon assembling; the intersection line of the two hollow parts K1 and K2 is rounded to have a diameter D5 corresponding to the position of the layer 25 upon assembling. Dimensions D3, D4, D5 are in the order D5<D3<D4.1<D4. This dimensional relationship helps fit the lid and the jointing ring into the bottle opening more easily. In general, the diameter of the bottle opening tends to narrow/reduce from up to bottom. However, based on the dimensional conversion, there is a localized dimensional difference between these parts: D4>D4.1; D3>D5 in a position for assembling sealing layers so that sealing layers 21, 24, 25, 26 lean on walls, respectively, on the bottle opening. The bottle's neck is in two opposite directions making an auto-lock structure both to seal and to auto-loose the lid 1.

Operation Principle

To contain the liquid in a ceramic bottle is based on a principle using a rubber jointing ring with an auto-lock valve, particularly:

Step 1: To assemble the rubber jointing ring part 2 to the lid 1. The bottom part of the lid 1 must contact the sole part of the rubber jointing ring 2, and the top layer 21 of the rubber jointing ring 2 contacts the bottom surface of the raised edge 12 on the lid. When assembling, the air inside the rubber jointing ring 2 passes through two vapor escaping grooves 15 of the lid body to go to the outside to be more easily assembled. The raised edge 16 on the lid is entirely inside the sole part 28 of the rubber jointing ring 2 so it is difficult for the rubber jointing ring to come out of the lid.

Step 2: To put the liquid into the container, the liquid contained inside may be much or less depending on the user's need.

Step 3: To use the lid 1 attached to the rubber jointing ring 2 to connect to the water bottle. When closing the lid, the air inside the bottle escapes through the gap 27 on the layers of the rubber jointing ring 2 to go outside. After the air escapes to the outside, the rubber jointing ring will gradually close the gap 27 when inserting the lid deeply into the water bottle. Thus, the rubber jointing ring's auto-lock valve structure lets only the air escape. Therefore, the opening and closing of the lid become more easily. Simultaneously, it prevents the inside liquid from escaping.

Utility: The auto-lock valve principle of the rubber jointing ring includes all of the following conveniences:

It may be used for all products using rubber jointing rings.

The production cost of the rubber jointing ring according to the above principle is low, given a high economic effect.

The shape of the rubber jointing ring is designed in a monobloc with an excellent aesthetic.

The rubber jointing ring is designed in a monobloc so that overcome thoroughly drawbacks: The rubber jointing ring part separated from the lid part results in that the inside liquid leaks along to the gap between the jointing ring and the lid, then it sticks inside the gap so that it is difficult to be cleaned up by the user. Simultaneously, the parts jointed by the rubber jointing ring will increase their tightness and seal because the inside air escaped out completely.

The present invention has simple usage, easy implementation, and convenience for all applications.

The invention claimed is:

1. An auto-lock sealing valve structure of a rubber jointing ring having an auto-lock valve comprising:

a container;

a lid, the lid comprising:

an outside rim as a handle;

a lid body having a circular cylinder shape extending downwardly;

two vapor escaping grooves each disposed on opposing side surfaces of the lid body, the two vapor escaping grooves being provided symmetrically with respect to a center of the lid; and a sole part having an outwardly extending edge, the sole part having an outer diameter larger than an outer diameter of the lid body; and a rubber jointing ring comprising:

a body part which is a hollow cylinder;

four jointing ring layers disposed on an outside of the body part, a topmost jointing ring layer of the four jointing ring layers, immediate adjacent to an under side of the lid, having an upwardly expanding part, the topmost jointing ring layer being configured to be inserted in to a gap between the lid and an opening of the container; and gaps disposed in a surface of each of the four jointing ring layers except the topmost jointing ring layer, the gaps being regularly and centrally symmetrically spaced around a circumference of each of the jointing ring layers except the topmost jointing ring layer, wherein the four jointing ring layers each have a circular shape, an upper surface and a bottom surface, wherein the container has a top part with an opening part and a cylindrical bottleneck, which is successively larger from a top of the container toward a bottom of the container.

2. The auto-lock sealing valve structure according to claim 1, wherein the lid further comprises:

a curved top portion, wherein the lid body is connected to an extends downward from the top portion;

concentric grooves on an outside of the curved top portion, the grooves having a depth in a range from about 0.5 mm-1 mm; and a concave part disposed between and connecting the curved top portion and the leg.

3. The auto-lock sealing valve structure according to claim 1, wherein the outer diameter of the sole part is larger than the outer diameter of the lid body by 1-2 mm, and wherein two small radial holes are disposed in a middle of the lid body.

4. The auto-lock sealing valve structure according to claim 1, wherein an outer rim diameter of the four jointing rings equals an outer diameter of the lid and an outer diameter of the container opening.

5. The auto-lock sealing valve structure according to claim 1, wherein the outer rim diameter of the four jointing ring layers successively reduces from a top of the lid to a bottom of the lid.

6. A container using the lid attached to the rubber jointing ring having the sealing structure according to claim 1.

7. The auto-lock sealing valve structure according to claim 1, wherein the bottle opening and a neck of the bottle are composed of two interconnected hollow parts, a top one of the hollow parts directly contacting the container opening.

* * * * *